United States Patent [19]

Hoddinott et al.

[11] 4,111,376

[45] Sep. 5, 1978

[54] CONTINUOUS STRAND WINDING APPARATUS

[75] Inventors: David C. Hoddinott, N. Stonington; Albert P. Brown, Gales Ferry, both of Conn.

[73] Assignee: Crompton & Knowles Corporation, New York, N.Y.

[21] Appl. No.: 822,751

[22] Filed: Aug. 8, 1977

[51] Int. Cl.[2] ..... B65H 54/02; B65H 67/04

[52] U.S. Cl. ..... 242/25 A

[58] Field of Search ..... 242/25 A, 25 R, 18 A

[56] References Cited

U.S. PATENT DOCUMENTS

| | | | |
|---|---|---|---|
| 2,653,773 | 9/1953 | Davis | 242/25 A |
| 2,779,545 | 1/1957 | Hauck et al. | 242/25 A |
| 2,893,652 | 7/1959 | Davis | 242/25 A |
| 2,913,191 | 11/1959 | Nelson | 242/25 A |
| 2,930,537 | 3/1960 | Davis et al. | 242/25 A |
| 2,932,462 | 4/1960 | Nelson | 242/25 A |
| 3,026,053 | 3/1962 | Sisson et al. | 242/25 A |
| 3,051,403 | 8/1962 | Johnson | 242/25 A |
| 3,064,912 | 11/1962 | Bittman | 242/25 A |
| 3,080,128 | 3/1963 | Hauer | 242/25 A |
| 3,098,621 | 7/1963 | Nelson et al. | 242/25 A X |
| 3,182,921 | 5/1965 | Nelson | 242/25 A |
| 3,323,735 | 6/1967 | Diehl | 242/25 A |
| 3,368,765 | 2/1968 | O'Grady | 242/25 A |
| 3,596,844 | 8/1971 | Engmann | 242/25 A |
| 3,761,030 | 9/1973 | Leinonen et al. | 242/25 A |
| 3,990,645 | 11/1976 | Vidler | 242/25 A |

FOREIGN PATENT DOCUMENTS

| | | | |
|---|---|---|---|
| 2,015,002 | 10/1971 | Fed. Rep. of Germany | 242/25 A |
| 2,015,003 | 10/1971 | Fed. Rep. of Germany | 242/25 A |
| 1,199,734 | 7/1970 | United Kingdom | 242/25 A |

*Primary Examiner*—Stanley N. Gilreath
*Attorney, Agent, or Firm*—Howard G. Garner

[57] ABSTRACT

Winding apparatus for the continuous winding of an advancing strand, having two coaxially mounted, spaced and independently driven, removable reels and a traverse mechanism for delivering strand to the reels alternately. Each of these reels is mounted on an axle which is equipped with a machine reel and snagger means assembly which is a permanent part of the machine and each of them are mounted adjacent to the remote ends of said reels when said reels are in winding position so that the reels are disposed for rotation about a common axis between the machine reels and snagger means assembly. The traverse means is controlled so as to distribute the strand onto one of the reels until a predetermined length of strand is wound thereon. Further means is provided for rapidly moving the traverse means across the empty reel into a position for directing the strand onto the machine reel associated with the empty reel. Means are also provided to restrain the strand while said traverse means is moving across the empty spool into position to wind on the machine reel. Once the traverse means is in position to wind on the other machine reel, the restraining means are removed and the strand is brought into contact with the snagger for the empty reel. After at least one revolution of the strand is wound onto the machine reel, cutter means is actuated to cut said strand adjacent to the snagger means but between the snagger means and the filled reel. This operation is controlled by a device that counts a predetermined number of revolutions. A second device is also utilized to count a second predetermined number of revolutions greater than the first so that a predetermined number of revolutions of the strand will be wound on the machine reel. After this second predetermined number of revolutions have been attained, the traverse means is moved into normal winding position on the empty reel and normal winding thereon is continued until that reel is filled.

10 Claims, 16 Drawing Figures

LINE INDEX
498
499
500
501
502
503
504
505
506
507
508
509
510
511
512
513
514
515
516
517
518
519
520
521
522
523
524
525
ML5
ML4
ML6
MR4
MR5
MR6
210
586
570
L.H. TRAV. CLUTCH
204
R.H. TRAV. CLUTCH
206
566
568
ML3
MR3
1LR3
1LR4
ML2
574
100
576
100'
606
604
MR1
MR2
3CR5
1LR1
1 LR
1LR2
ML1
2CR5
2CR4
579
2LR4
2 LR
2LR5
3CR4
3TR4
MR
QUICK TRAVERSE R.
585
2LR1
3TR2
2LR2
3TR3
584
3TR5
ML
QUICK TRAVERSE L.
1LS
4CR1
L.H. KNIFE CUT
593
2 CR
2LS
4CR2
R.H. KNIFE CUT
608
3 CR

LINEAR COUNTER
#1 ROTATION COUNTER
#2 ROTATION COUNTER
4 CR
1 TR
5 CR
3 TR
RELEASE L.H. BRAKE, ENGAGE L.H. DRIVE BELTS
RELEASE R.H. BRAKE, ENGAGE R.H. DRIVE BELTS
L.H. FAST TRAV. CYLINDER
R.H. FAST TRAV. CYLINDER

CONTINUOUS STRAND WINDING APPARATUS

BACKGROUND OF THE INVENTION

This invention relates generally to reel winding apparatus, and more particularly to apparatus for winding continuously feed flexible strand onto reels.

Reel winding apparatus of a type to which the present invention relates takes in continuously delivered strand and winds it in predetermined lengths onto successive reels for its convenient storage and transport until put to its ultimate use. Reel winding apparatus to which the present invention relates, more particularly, is of the type having provision for removably supporting two reels side-by-side, one reel being wound at a time until full whereupon the other reel is wound while the full reel is removed from the apparatus and replaced by an empty reel to be wound next. The reels in the apparatus are separately power driven under suitable control and the stock is directed onto the respective reels in orderly layers by a traverse means which moves back and forth for this purpose, and which also crosses over from the winding relation with each full reel into winding relation with the adjacent empty reel so as to maintain the strand winding operation on a continuous basis. To this end, the drive of the empty reel is started when the other reel is still winding so that both reels will be driven when the latter reel is fully wound and the traverse means has crossed over into winding relation with the empty reel. In previous reel winding apparatus, for example as shown in U.S. Pat. No. 2,932,462, issued Apr. 12, 1960 to Alden W. Nelson, the strands crossing from the full reel to the empty reel were permitted to become anchored to snaggers on a disc located adjacent to the inside heads of the reel. In this apparatus provision was made for winding a portion of the strand first on an extension of the hub or barrel of the reel.

In other more recent winding apparatuses, a separate snagger and machine reel assembly have been fitted onto the inner ends of the shafts supporting each reel and a random amount of strand has been wound on the machine reel at that point. One problem created by this type of mechanism, is that it requires the operator to remove the machine reel and snagger assembly before he can remove the filled reel of strand, thus necessitating unnecessary handling of a very heavy piece of the winding mechanism. Also the random amount of wire wound on the machine reel leads to waste on some reels in order to ensure a minimum on all.

SUMMARY OF THE INVENTION

The present invention comprises a continuous winding apparatus for the continuous winding of strand and includes a pair of spaced independently driven rotatable and removable reels in order to overcome the shortcomings of the prior art. The machine reel and snagger assemblies are made a permanent part of the machine, that is, they are not normally removed when full reels are removed from the winding apparatus. In the invention the machine reel and snagger assemblies are mounted at the outer ends of the reels onto which the strand is to be wound and are made a part of the machine by suitable mounting on the shaft on which the reels are mounted. That is they are attached for rotation with their respective shafts. Thus the reels onto which the strand is to be wound are fitted against the snagger and machine reel assembly and held in place during normal winding operations by means of a lock nut or the like.

Provision is made to drive the strand traverse mechanism so as to lay the strand evenly on one of said reels until a predetermined length of strand is wound thereon. Thereafter, the traverse means is moved rapidly across the empty reel while the strand is retained in winding relationship with the filled reel by means of suitable restraining rolls similar to those shown in U.S. Pat. No. 2,932,462, identified above. The traverse means moves into position to wind a predetermined amount of strand onto the machine reel associated with the opposite reel and the restraining means is removed, permitting the strand to move into the path of the snagger means as soon as the traverse means is in place. After at least one revolution, which is predetermined, suitable cutter means are actuated to sever the strand adjacent to the snagger disc of the snagger and machine reel assembly. However, this is done only after the strand is firmly anchored by the snagger disc and at least one revolution of strand has been wound on the machine reel. Thereafter, a second predetermined number of revolutions are wound onto the machine reel after which time the traverse mechanism is moved into normal winding relationship with the empty reel and continues to wind until said reel is filled with a predetermined length of strand. After the reel is filled, the traverse mechanism moves in the opposite direction to perform the same functions described herein with regard to the other reel.

After the transfer is complete the filled reel is stopped and may be removed by the operator while the other reel is being filled with strand. After replacing the filled reel with an empty one, the operator manually restarts the rotation of the empty reel or, alternatively, the control circuit may be programmed to re-start its rotation when the reel being filled has a predetermined length of strand wound thereon.

BRIEF DESCRIPTION OF THE DRAWINGS

The invention will now be described, by way of example, with reference to the accompanying partly diagramatic, drawings in which.

DETAIL DESCRIPTION OF THE INVENTION

Figure 1:
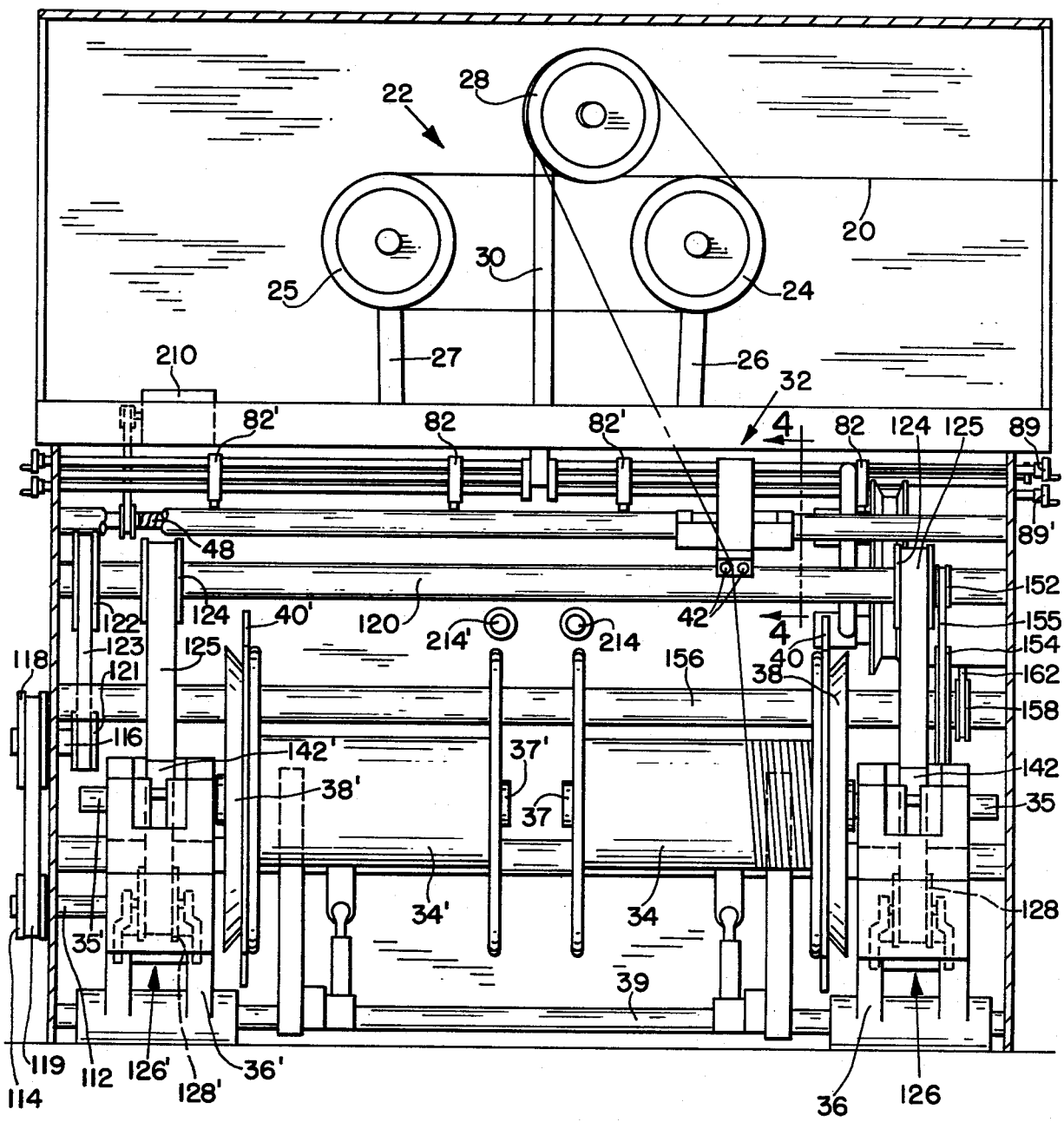
FIG. 1 is a front view of the strand winding apparatus embodying the present invention with non-essential parts removed and other parts shown in section for sake of clarity.
Figure 2:
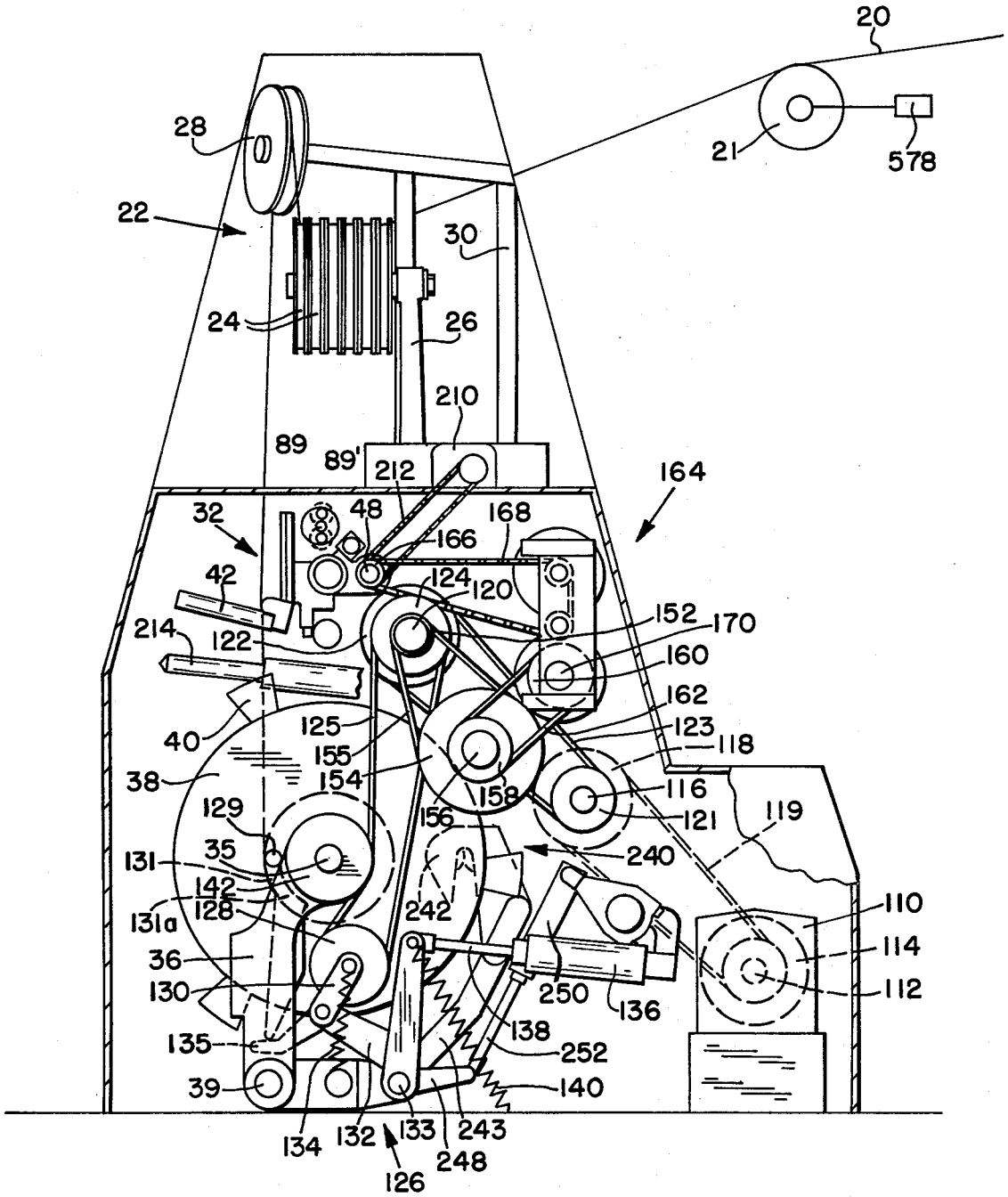
FIG. 2 is a side view of the strand winding apparatus shown in FIG. 1 with some parts shown in section and non-essential parts such as covers removed for sake of clarity.

Referring now to FIGS. 1 and 2, it will be seen that strand 20 is supplied (by means not shown) to a capstan 21 which advances the strand at a constant rate of speed. Attached to the shaft supporting capstan 21 is a linear footage counter 578 which measures the strand as it passes about the capstand. Strand 20 is fed from the capstan into an accumulator 22 which will accumulate the strand. This accumulator is not part of the present invention and any standard accumulator can perform this function, however, it has been found that the accumulator shown in U.S. Pat. No. 2,913,191 is suitable for the purposes of this machine. As seen in FIG. 1, the accumulator comprises accumulator sheaves 24 and 25 which are mounted on tension arms 26 and 27. Strand 20 is guided about the accumulator sheaves on to a guide sheave 28 which is mounted on a guide sheave support member 30. The strand is guided from the guide sheave into a traverse mechanism 32 which will be described in more detail hereinafter.

Traverse mechanism 32 guides the strand 20 onto either reel 34 or 34' depending on which of the reels are being filled. As seen in FIG. 1, the strand is being guided onto reel 34. Reel 34 is mounted on a shaft 35 which is supported in turn by reel support arm 36 which is pivoted about shaft 39. Also mounted on shaft 35 is a machine reel 38 and a snagger 40 which in practise are coupled together as a unitary unit and stay with the machine unless it is necessary to move them for repair or for a different size.

Reel 34 is removable from shaft 35 and is held in place during the winding operation by locknut 37.

The left hand reel 34' is mounted on a shaft 35' which is supported by reel support arm 36' and has a machine reel 38' and a snagger 40' fitted to shaft 35'. Here, as with regard to the right hand reel 34, reel 34' is held removably in place on shaft 35' by locknut 37'.

Figure 3:
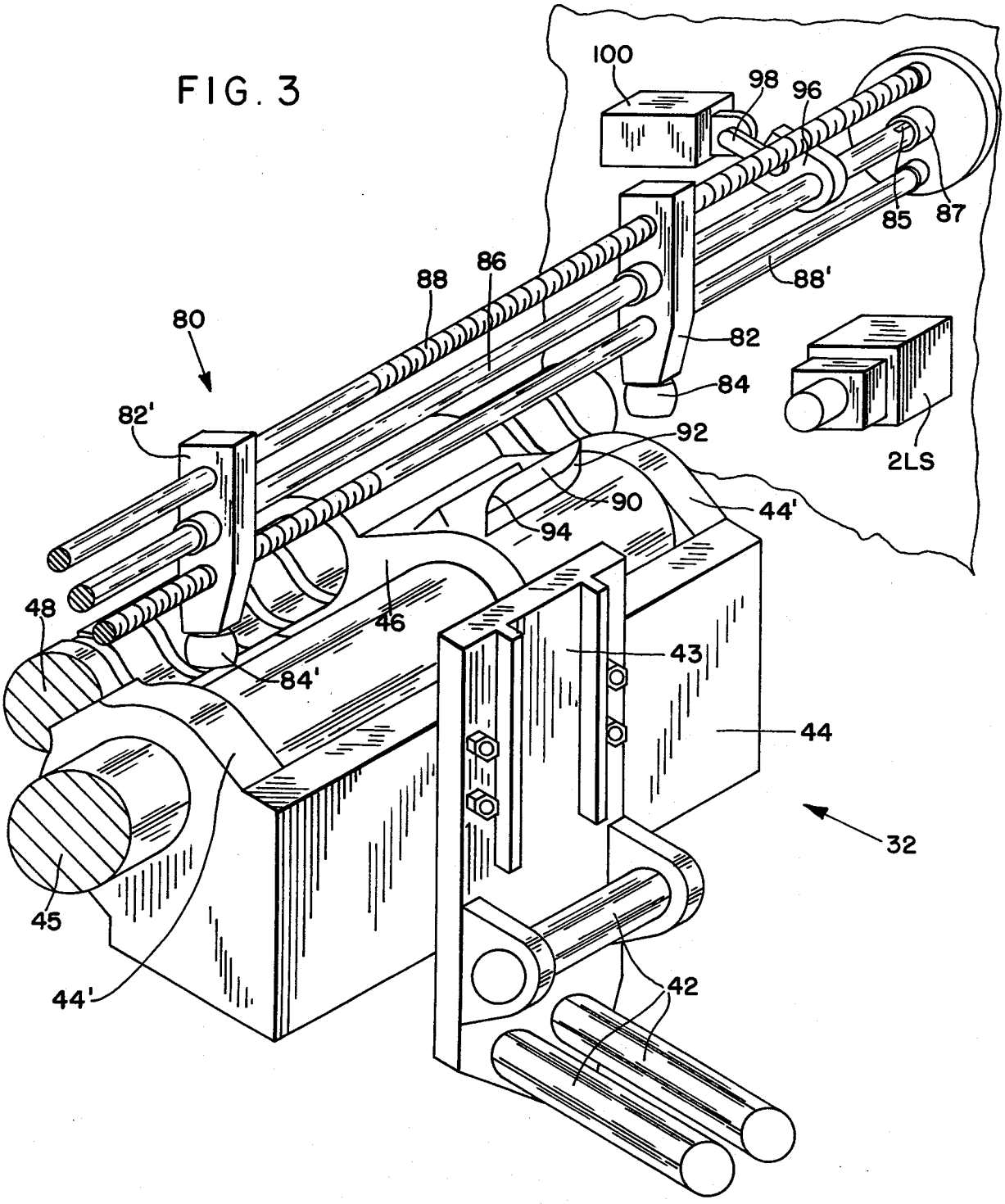
FIG. 3 is an enlarged perspective view of the traversing mechanism for the strand winding apparatus shown in FIG. 1.
Figure 4:
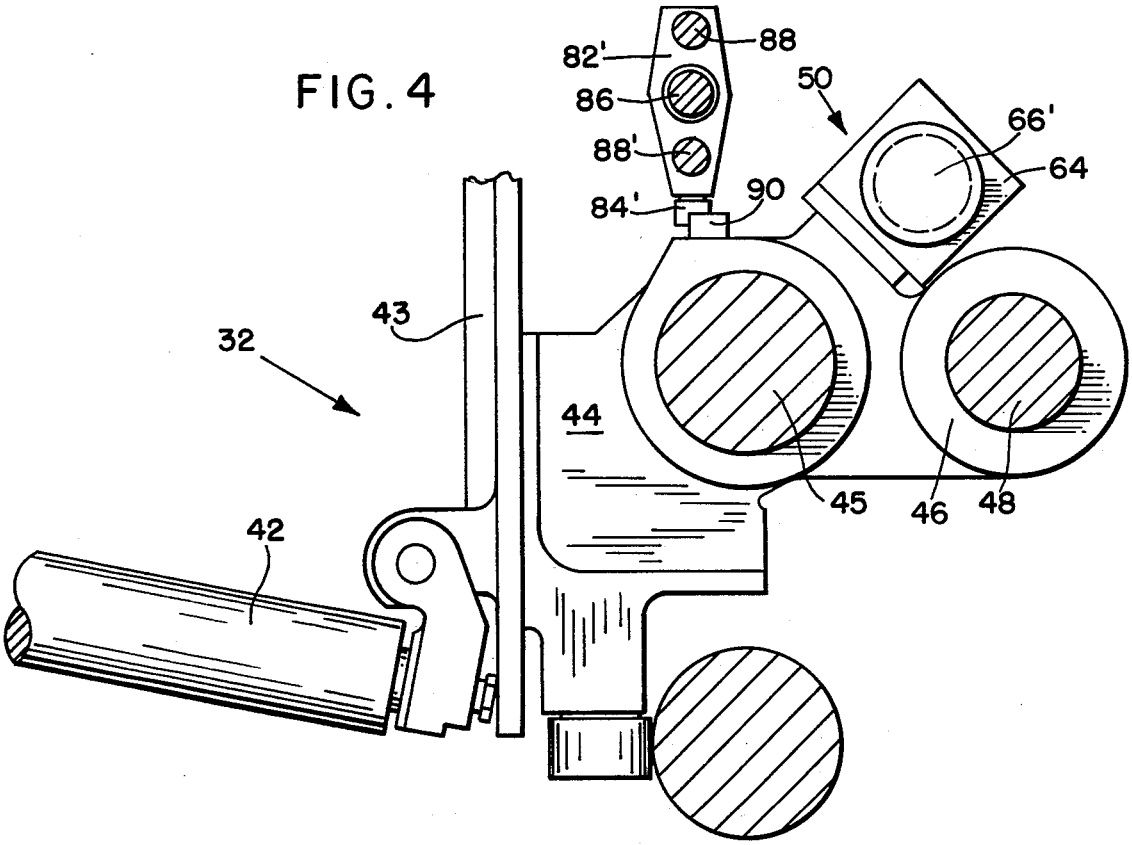
FIG. 4 is a side sectional view of the traversing mechanism shown in FIG. 3.
Figure 5:
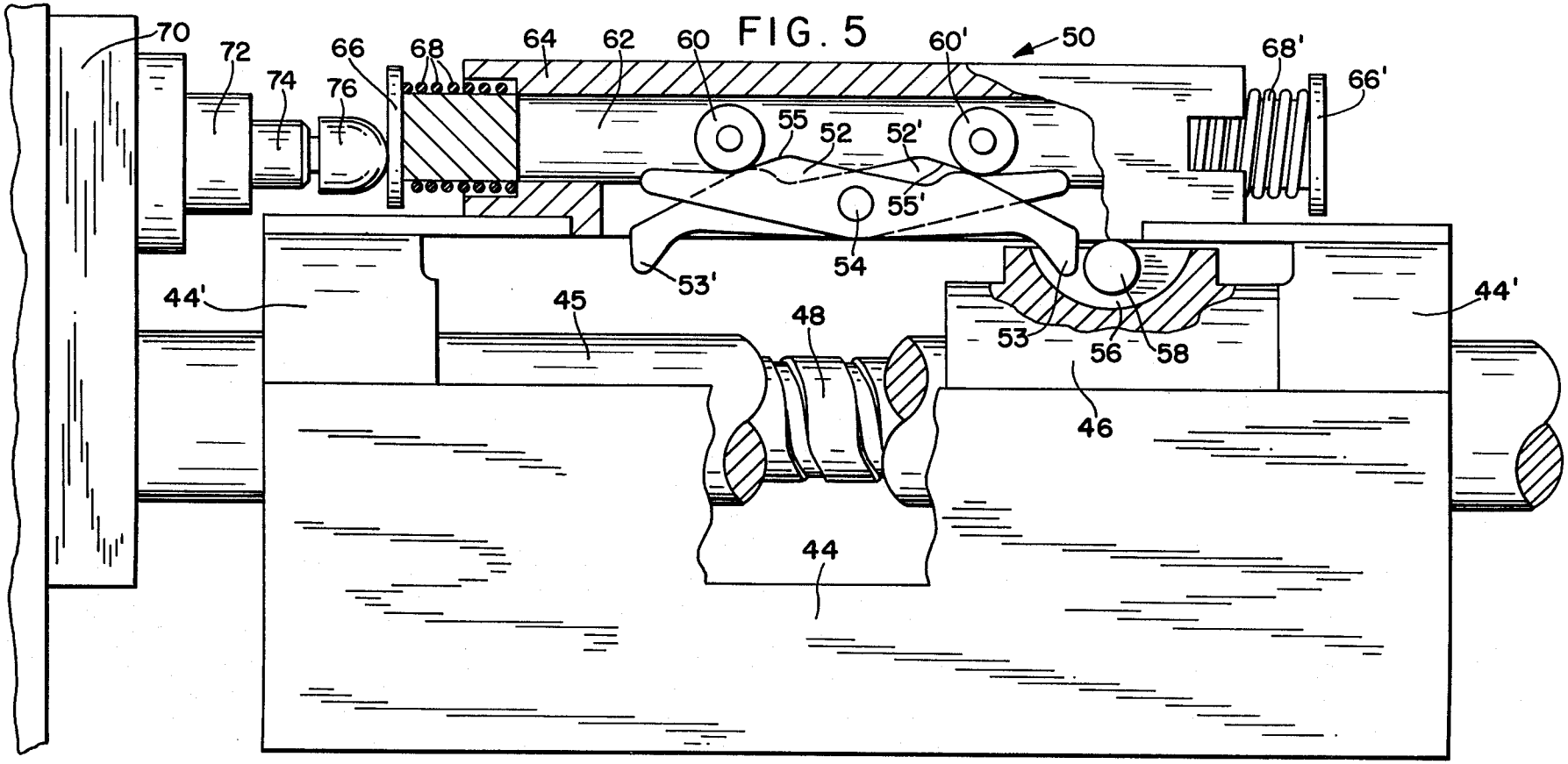
FIG. 5 is a front view of the traversing mechanism shown in FIGS. 4 with some parts in sections and others cut away for sake of clarity.
Figure 5A:
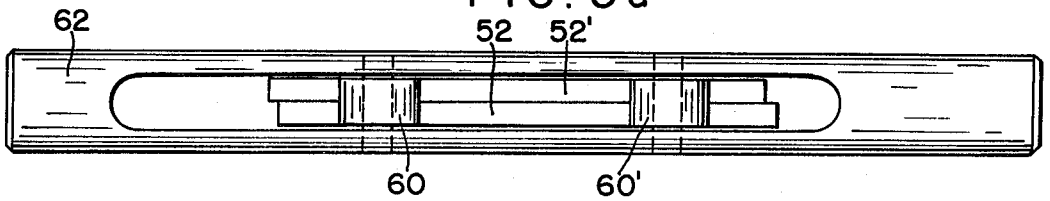
FIG. 5A is an enlarged view of the latch shaft shown in FIG. 5.

Traverse mechanism 32 is shown in more detail in FIGS. 3, 4, and 5. This mechanism comprises a series of traverse rolls 42 for guiding strand 20. Rolls 42 are mounted on a traverse roll bracket 43 which, in turn, is attached to a traverse block 44 which has two traverse block arms 44'. Extending through arms 44' is a tie rod 45 and arms 44' are provided with suitable bushings to permit tie rod 45 to guide the traverse of the traverse block. These bushings are not shown in the present drawings but any suitable bearings or bushings can perform this function. Accordingly traverse block 44 is mounted traversing movement along tie rod 45.

Extending between traverse block arms 44' is a traverse nut 46 which is threaded onto a traverse screw 48 which lies outside of arms 44'. As seen in FIGS. 3 and 5, the traverse nut has a portion which extends between arms 44'. This extension is also fitted with a bushing and is guided along tie rod 45. During normal operations nut 46 is latched to traverse block 44 by means of a traverse nut latching mechanism 50. At times latch mechanism 50 is disengaged and the blocks 44 is permitted to move independently of traverse nut 46.

Latching mechanism 50 comprises latch arms 52 and 52'. These arms are provided with latch dogs 53 and 53'. Latch arms 52 and 52' are pivoted about pivot 54. Pivot 54 is mounted in latch housing 64. Latch dogs 53 and 53' are adapted to extend into depression 56 and to lock the traverse nut 46 to traverse block 44 through the latching mechanism for traverse therewith. As shown in FIG. 5, dog 53 is locked into depression 56 to the left of latch roller 58 which is pivoted in nut 46.

The latch mechanism also includes a latch housing 64 into which a latch shaft 62 is slidably fitted. As shown in FIG. 5, this shaft is held in locking position with follower rolls 60 and 60' engaging locking surfaces 61 and 61' of latch arms of 52 and 52' so that the latch dogs are locked into position as seen in FIG. 5. Latch shaft 62 is provided on either end with contact heads 66 and 66' and is normally held in the locking position shown in FIG. 5 by means of shaft springs 68 and 68'. As shown in FIG. 5, the traverse nut is in its position for normal traverse when the strand is being wound onto the right reel and the left machine reel.

On the right and the left sides of the machine, adjacent to the machine reel on frame member 70 is mounted a pneumatic cylinder 72 which has a piston rod 74 which carries a piston rod head 76.

As noted above, traverse nut 46 is latched to traverse block 44 in the position for normal traverse on the right reel and the left machine reel. However, as shown in FIG. 5, the traverse block is in the position to wind the strand onto the machine reel on the left side. Once the predetermined amount of strand is wound onto the machine reel, pneumatic cylinder 72 is activated (by means not shown herein but which will be described in detail hereinafter). Piston rod head 76 strikes contact head 66 which moves latch shaft 62 to the right of FIG. 5, initially overcoming the resistance of spring 68. This moves follower rolls 60 and 60' relative to latch arms 52 and 52'. Follower 60 engages cam surface 55 of latch arm 52 and pivots latch arm 52 about pivot 54 tO disengage latch dog 53 from depression 56. As piston rod 74 continues to push upon contact head 66, traverse block 44 is moved out of engagement with traverse nut 46 and latch arm 52' rides over nut 46 and latch roller 58 as the block moves to the right until latch dog 53' engages depression 56 to the right of latch roller 58. This in turn locks the traverse nut to the traverse block for normal traverse on the left reel. When the left reel is filled with the predetermined length of strand, the traverse block is moved to the right of the machine as seen in FIG. 1 into a position for winding the strand onto the machine reel associated with the right reel and the operation performed with regard to the left machine reel is repeated on the right machine reel. The pneumatic cylinder for activating the latch releasing mechanism for the right hand reel has not been shown but would be identical to that shown in FIG. 5 except that the arrangement would be reversed.

As seen in FIGS. 1, 2, 3 and 4, the winding apparatus of the present invention includes a traverse limit control mechanism 80 which is adjustable and which controls the traverse of the traverse mechanism 32 so that it will traverse sufficiently to fill the particular size reel mounted on the machine. As seen in FIG. 1, each reel is provided with a pair of trip dogs 82 and 82', as will be described in more detail hereinafter. The positions of trip dogs 82 and 82' determine the length of the traverse during the normal traverse of the strand when filling the reels. As best seen in FIG. 3, this mechanism comprises trip dogs 82 and 82' each of which are equipped with a follower 84 and 84' respectively. Trip dogs 82 and a82' are mounted on trip shaft 86 with a suitable bushing for axial movement therealong. Also extending through trip dogs 82 and 82' are trip dog adjusting rods 88 and 88'. Rod 88 is threaded into trip dog 82 while rod 88' is treaded into trip dog 82'. Rod 88' passes through the trip dog 82 and rod 88 passes through trip dog 82' with enough clearance to permit sliding movement therealong. Adjusting rods 88 and 88' are equipped with adjusting handles 89 and 89'.

Figure 6:
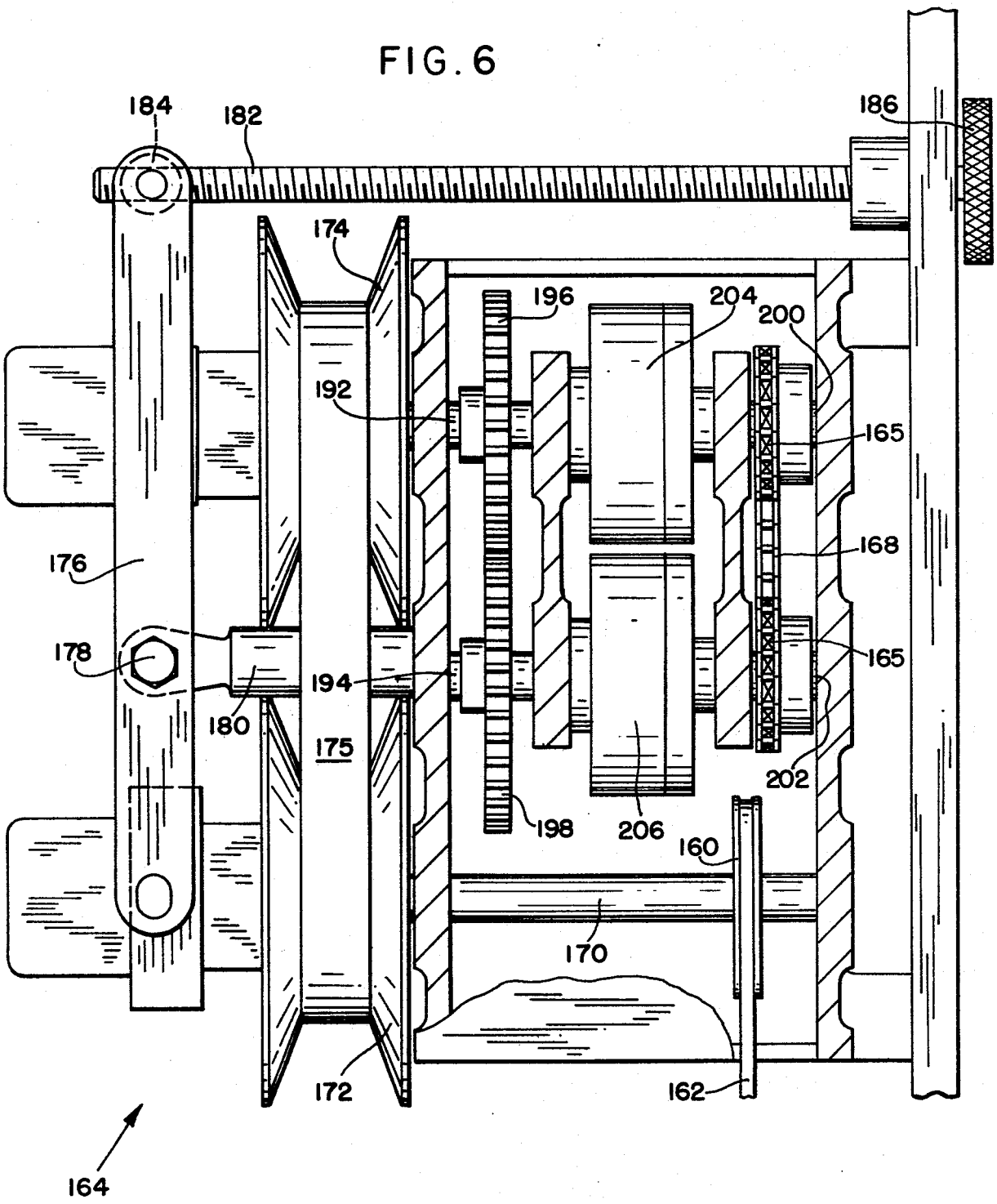
FIG. 6 is an enlarged front view of the traverse clutch mechanism.

As seen in FIG. 1, 2 and 3 manual rotation of these rods will position trip dogs 82 and 82' to coincide with the desired length of traverse. Trip shaft 86 and adjusting rods 88 and 88' are mounted in a bearing hub 87 and rotate or revolve as a unit about the axis of trip shaft 86. Shaft 86 is keyed to hub 87 by a set screw or suitable key number 85. Fixed to trip shaft 86 is switch yoke 96 into which fits a switch arm 98 of limit switch 100. Switch arm 98 is spring urged into a neutral or open position during normal operation. However, trip dog 82 is in a position for its follower 84 to be tripped by cam surface 92 of trip cam 90 when the traverse mechanism reaches it. Trip cam 90 cams the follower counter clockwise as seen in FIG. 3 and causes the trip shaft 86 to revolve about its axis and, through yoke 96, to close switch 100 so as to reverse the direction of rotation of the traverse screw 48 to reverse the traverse through the clutch mechanism 164 as shown in FIG. 6, which will be described in detail hereinafter. As noted above, switch arm 98 is spring biased into open or neutral position and in turn this positions the trip dog assembly into a neutral position until the follower 84 thereof is tripped by the trip cam. Trip dog 82' is positioned by the spring biased switch arm so that cam surface 94 will move cam follower 84 in a clockwise direction as seen in FIG. 3, thereby closing switch 100 in the opposite direction to reverse the rotational direction of screw 48.

While FIG. 3 illustrates the right hand reel traverse limiting control mechanism, the left reel is equipped with an identical mechanism for controlling the traverse when the strand is being wound thereon. For sake for brevity, it has not been deemed necessary to described and illustrate this mechanism with respect to the left reel since it is merely duplicative of that shown in FIG. 3 for the right reel.

Also seen in FIG. 3 is a limit switch 2LS which is in a position to be contacted by traverse block 44 when the traverse block is in the position to wind strand onto the right machine reel. When this switch is actuated, if disables the normal traverse mechanism electrically and starts two revolutions counters which count the revolutions of the reel and retracts restraining rolls 214 and 214' in a manner that will be discussed in detail hereinafter. As pointed out hereinabove, FIG. 3 illustrates the mechanism for the right reel. The left reel is also equipped with a limit switch 1LS for the same purpose, which is not seen in this Figure.

Referring now to FIGS. 1 and 2 it will be seen that power for driving the winding apparatus originates with motor 110 which has a motor shaft 112. Keyed to motor shaft 112 is a motor sheave 114 which drives a jack shaft 116 through a jack sheave 118 by means of a jack shaft belt 119. On the other end of the jack shaft is keyed a sheave 121 which drives main shaft 120 through main sheave 122 and the main shaft drive belt 123. Main shaft 120 also carries reel drive sheaves 124 and 124' about which are entrained reel drive belts 125 and 125' for driving idler sheave assemblies 126 and 126'.

Idler sheave assembly 126 and 126' are identical. However, only 126 has been shown in detail. It has not been thought necessary to illustrate and describe assembly 126' in detail. Idler sheave assembly 126 comprises an idler sheave 128 which is mounted on idler sheave arm 130 which, in turn, is an extension of a bell crank 132 as seen in FIG. 2. Bell crank 132 is mounted for pivotal rotation on shaft 133.

Idler sheave arm 130 is pivoted to bell crank 132 and is spring loaded by means of spring 134 for maintaining tension on reel drive belt 125 as seen in FIG. 2. Shaft 35 is equipped with reel sheave 142 which is adapted to be engaged by belt 125 to drive reel 34. The other end of bell crank 132 is attached to piston rod 138 of pneumatic piston 136. Cylinder 136 is activated by control means (hereinafter to be descried) to engage and disengage the belt 125 from reel sheave 35 to drive the reel as as desired or to apply brakes. Also associated with reel sheave 142 is a brake member 131 which is pivotally mounted on the arm 36 at 129. Brake member 131 has a brake dog **131*a* on its other end. 131*a* is in a position to be contacted by foot 135 of bell crank 132 when the idler sheave assembly is disengaged from drive relationship with sheave 142. Bell crank 132 is also provided with spring 140 which is adapted to rotate the bell crank lever clockwise about shaft 133** so that the reel will be stopped automatically should there be a power failure.

Main shaft 120 also has keyed thereto a traverse drive sheave 152. Sheave 152 drives a sheave 154 keyed to shaft 156 through belt 155. Shaft 156 also has keyed thereto a second sheave 158 which drives sheave 160 through belt 162. Sheave 160 is keyed to clutch input shaft 170 for rotation therewith.

FIG. 6 illustrates the traverse clutch mechanism for driving the traverse screw alternately in opposite rotational directions to change the direction for the traverse mechanism. Shaft 170 carries thereon a variable pitch pulley 172 which is operationally connected to a second variable pitch pulley 174 by means of a belt 175. The right side of variable pitch pulleys 172 and 174, as seen in FIG. 6, are fixed to their respective shafts 170 and 192. The left side of the variable pitch pulleys are keyed for sliding movement along their respective shafts and their position varies in order to vary the speed of the traverse mechanism. This is accomplished by means of pulley shift arm 176 which is mounted for pivotal movement about stud 178 on support member 180. As shift arm 176 is rocked counter clockwise, the speed of output shaft 192 will increase since the pitch diameter of its pulley will decrease while the pitch diameter of pulley 172 will increase. On the upper end of pulley shift arm 176 and pivotally mounted thereto is a pivoted block or rod 184 into which is threaded a pulley adjustment rod 182. On its other end rod 182 has an adjusting handle 186. In operation, the operator adjusts the position of variable pitch pulleys to adjust the speed of the traverse for different sizes of strands to be wound on the reel.

Output shaft 192 carries thereon a gear 196 which meshes with a gear 198 of the same size carried by a second output shaft 194 so that shaft 194 operates at the same rotational speed as does shaft 192 but in the opposite rotational direction. This transmission is also equipped with traverse shafts 200 and 202 each of which has thereon a sprocket 165 for rotation therewith. Drive chain 168 is entrained about sprocket 165 and 166 which is keyed to traverse screw 48. Shaft 200 may be connected to shaft 192 by means of an electromagnetic clutch 204 while shaft 202 may be operationally connected to shaft 194 by means of an electromagnetic clutch 206. Clutch 204 is activated by switch 100 or 100' as the case may be when trip dog 82 or 82' is rotated counter clockwise by trip cam 90 as seen in FIG. 3. This energizes clutch 204 and causes the traverse groove to be driven to move the traverse mechanism to the left. At the other end of the traverse, trip dog 82' is contacted by trip cam 90 to rotate the trip shaft 86 in a clockwise direction which operates switch 100 to energize electromagnetic clutch 206 so that sprocket 165 on shaft 202 drives the traverse groove in the opposite direction to cause the traverse mechanism to move to the right.

When linear counter 578 indicates that the predetermined length of strand has been wound onto a given reel, a rapid traverse reversible motor 210 is actuated to drive traverse screw 38 at an accelerated rotational speed through chain 212 through a sprocket which is keyed to the traverse screw, while at the same time it de-energizes electromagnetic clutches 204 and 206 to permit the traverse screw to be driven at said accelerated rotational speed. However, before the rapid traverse drive is energized, restraining rolls 214 or 214' are brought into position so as to intercept the strand guided by the traverse mechanism whenever said mechanism moves from the full reel to the empty one. After the restraining rolls are in place, the traverse screw is driven at said accelerated rate so as to move the traverse mechanism from the full reel into position over the machine reel on the opposite side of the machine. When moving to the left, block 44 trips the left limit swtich 1LS which starts counters 590 and 592 counting predetermined numbers of revolutions of the machine reel and activates other machine operations as hereinafter described in more detail.

Figure 7:
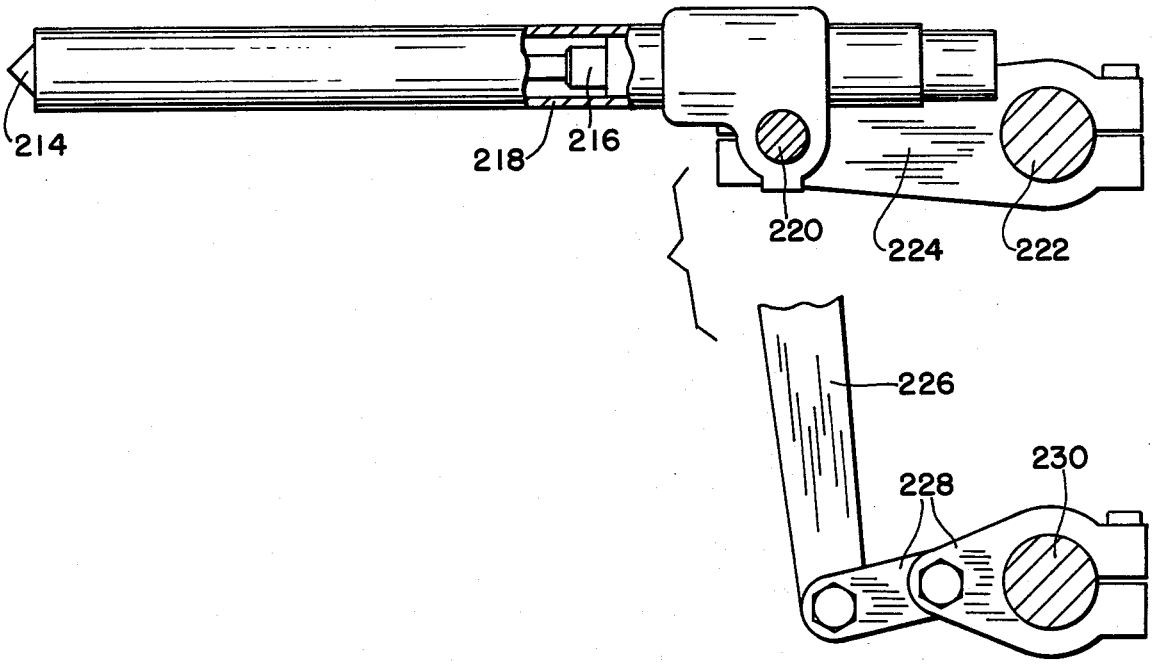
FIG. 7 is an enlarged side view of the restraining roll mechanism with the restraining rolls retracted.

Restraining rolls 214 and 214' are mounted as shown in FIG. 2 and in more detail in FIG. 7. This includes a restraining roll housing 218 into which is fitted a restraining roll pneumatic cylinder 216 which is adapted, when energized to extend restraining roll 214 or 214' as the case may be into the path of strand 20 as the traverse means moves to the empty reel. Housing 218 is mounted on a support shaft 220 and rear tie rod 222 by means of a restraining roll support bracket 224. The restraining roll support bracket is further supported by means of support arm 226 which is attached thereto at shaft 220 on its upper end and to a support arm linkage 228 at the lower end which in turn is attached to lower tie rod 230. The position of support arm linkage 228 is adjustable as in the position of the support roll bracket 224 on shaft 222 so as to position the restraining rolls near the inner reel flanges when different diameter reels are used.

Figure 8:
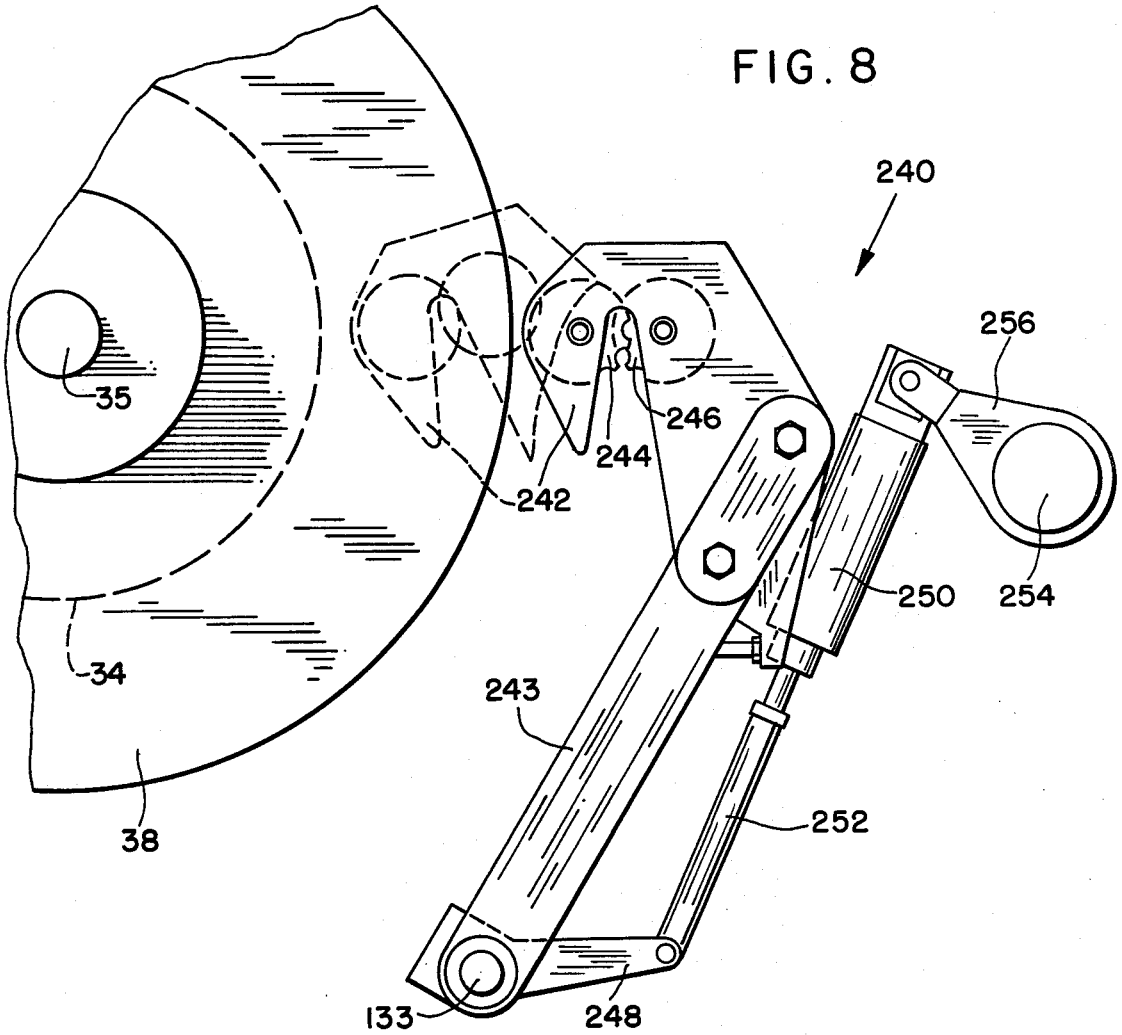
FIG. 8 is en enlarged side view of the cutter mechanism.

In FIGS. 2 and 8, the cutter assembly is shown for severing the strand after it has been transferred from the filled reel to the machine reel on the opposite side of the machine. This cutter severs the strand adjacent to the snagger on the empty reel after at least one revolution of strand has been wrapped about the machine reel. The cutter assembly is actuated by revolution counter 590 which is described in detail hereinafter in the control section of this application. The cutter assembly comprises a cutter head 242 which has mounted therein scolloped cutter wheels 244 and 246. while cutter wheels 244 and 246 are shown scolloped herein they could also have V-shaped recesses as well. Cutter head 242 is mounted on a cutter arm 243 which is pivotally supported on shaft 133. Attached to lever 243 is a cutter arm extension 248. Extension arm 248 is pivotally connected to a piston rod 252 of a pneumatic cylinder 250 which in turn is pivotally connected to a tie rod arm 256 fixed to tie rod 254. As seen in FIG. 8, cutter assembly 240 in the broken line position is in position for cutting strand brought into contact with cutting wheels 244 and 246 as set forth in detail hereinafter. The cylinder 150 is energized to bring the cutting head into the broken line position shown in FIG. 8 so as to intercept and to cut the strand being wound onto the machine reel. The full line position shows the cutter in the inoperative position.

Figure 9A:
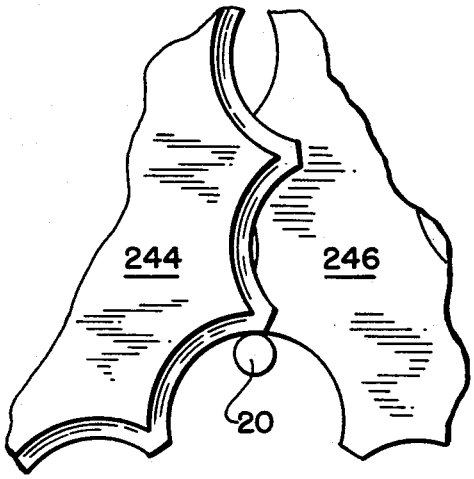
FIGS. 9A, 9B, and 9C show a further enlargement of the cutter blades as they operate to sever the strand.
Figure 9B:
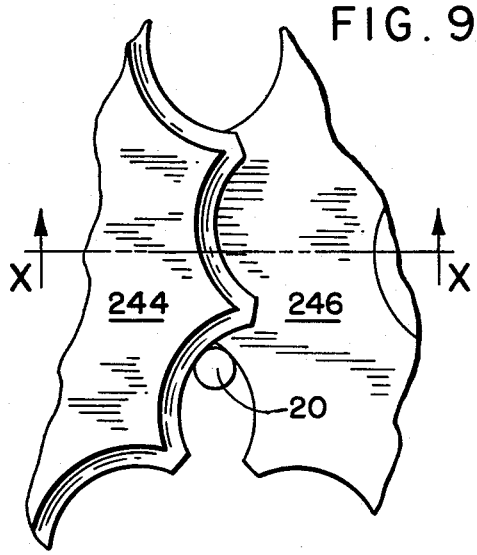
Figure 9C:
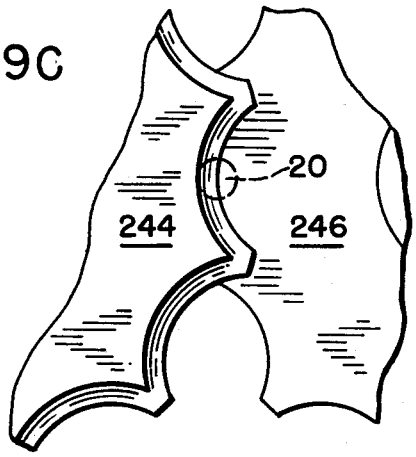

FIGS. 9A, 9B and 9C illustrate the steps of severing the strand by cutter blades or wheels 244 and 246. In FIG. 9A, we see strand 20 come into contact with cutter wheels 244 and 246. These wheels are mounted for free rotation about pivots in cutter head 242. As strand 20 engages the scolloped areas of the cutter blades, it causes them to rotate about their axis as seen in FIG. 9B. As the rotation continues, strand 20 is trapped in the scolloped area of the cutter blades and the strand is severed as seen in FIG. 9C.

Figure 10:
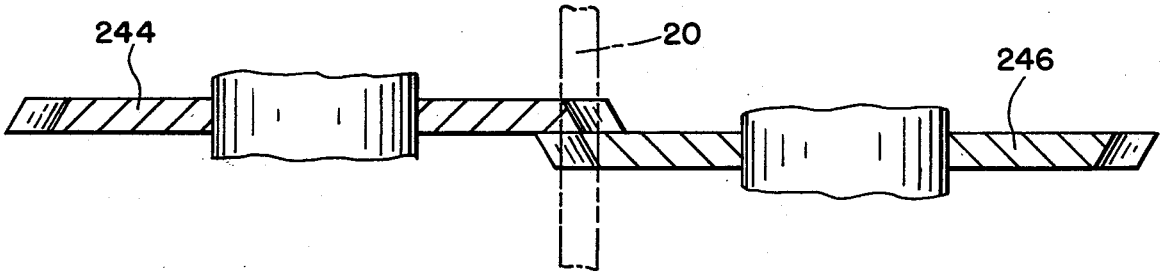
FIG. 10 shows a section of the cutter blades taken along line X—X of FIG. 9B.

FIG. 10 is a cross sectional view of the cutter blades showing how the cutting surfaces cooperate with each other.

Figure 11:
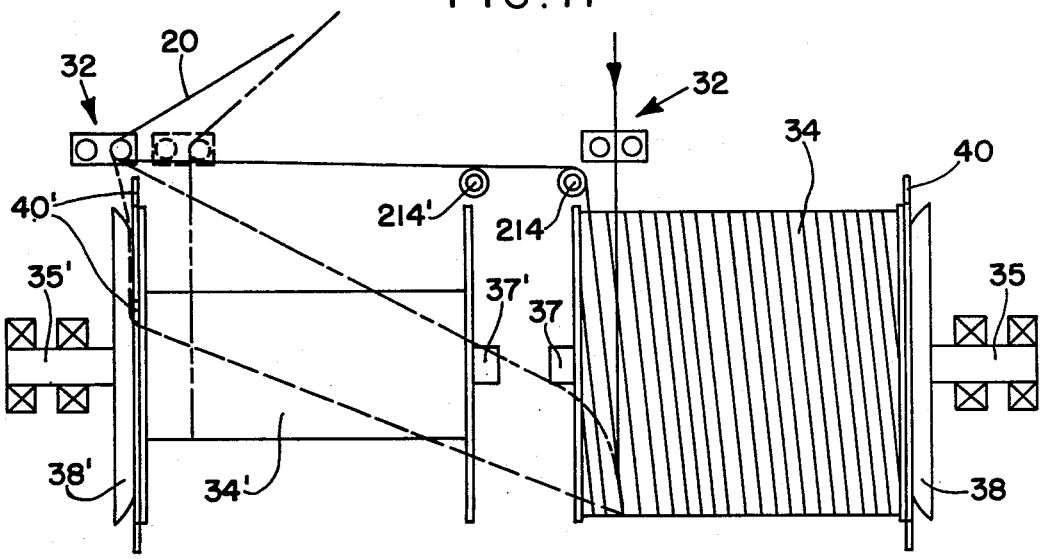
FIG. 11 is a diagramatic view of the transfer of the strand from the filled reel to the empty reel.

FIG. 11 is a diagramic view illustrating the transfer of the strand from the filled reel 34 to the empty reel 34'. In the first position traverse mechanism 32 is shown guiding strand to reel 34. After a predetermined length of strand has been wound thereon restraining roll 214 is activated and brought into position to intercept strand 20 as traverse mechanism 32 moves to the full line position shown over machine reel 38'. After the traverse mechanism has moved to the latter position, restraining roll 214 is withdrawn and the strand takes the intermediate broken line position which brings it into the path of the snagger 40'. As the snagger 40' engages the strand, it begins to wind a revolution thereof onto machine reel 38'. After one revolution or more of the strand has been wound onto the machine reel, the cutter mechanism is activated to sever the strand adjacent to the snagger 40'. Machine reel 38' continues to wind the strand and the traverse mechanism 32 remains in the left full line position until a predetermined number of revolutions of strands has been wound onto machine reel 38'. After said predetermined number of revolutions of strand has been wound onto the machine reel, the traverse mechanism is moved to the broken line position for normal traverse in winding the strand onto reel 34'. The control mechanism for controlling the operation of this apparatus will now be described in more detail with reference to FIGS. 12A and 12B.

Referring to the wiring diagram shown in FIGS. 12A and 12B, the electrical controls for a complete winding and transfer sequence will be described in detail. To the left of FIGS. 12A and 12B a line index is provided to make it easy in locating the lines of the circuit.

Figure 12A:
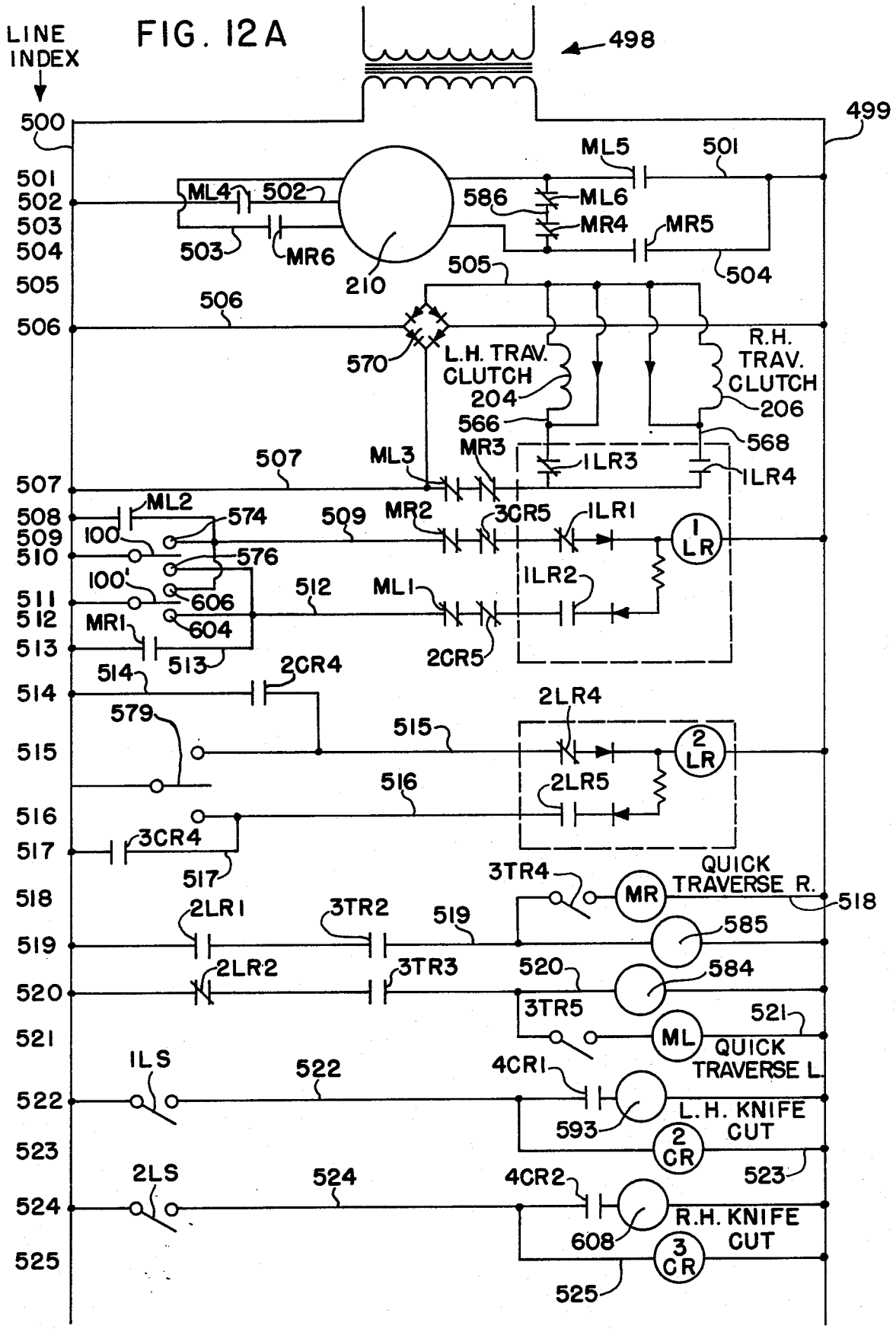
FIGS. 12A and 12B, together, illustrate the control circuitry for the winding apparatus shown in FIG. 1.
Figure 12B:
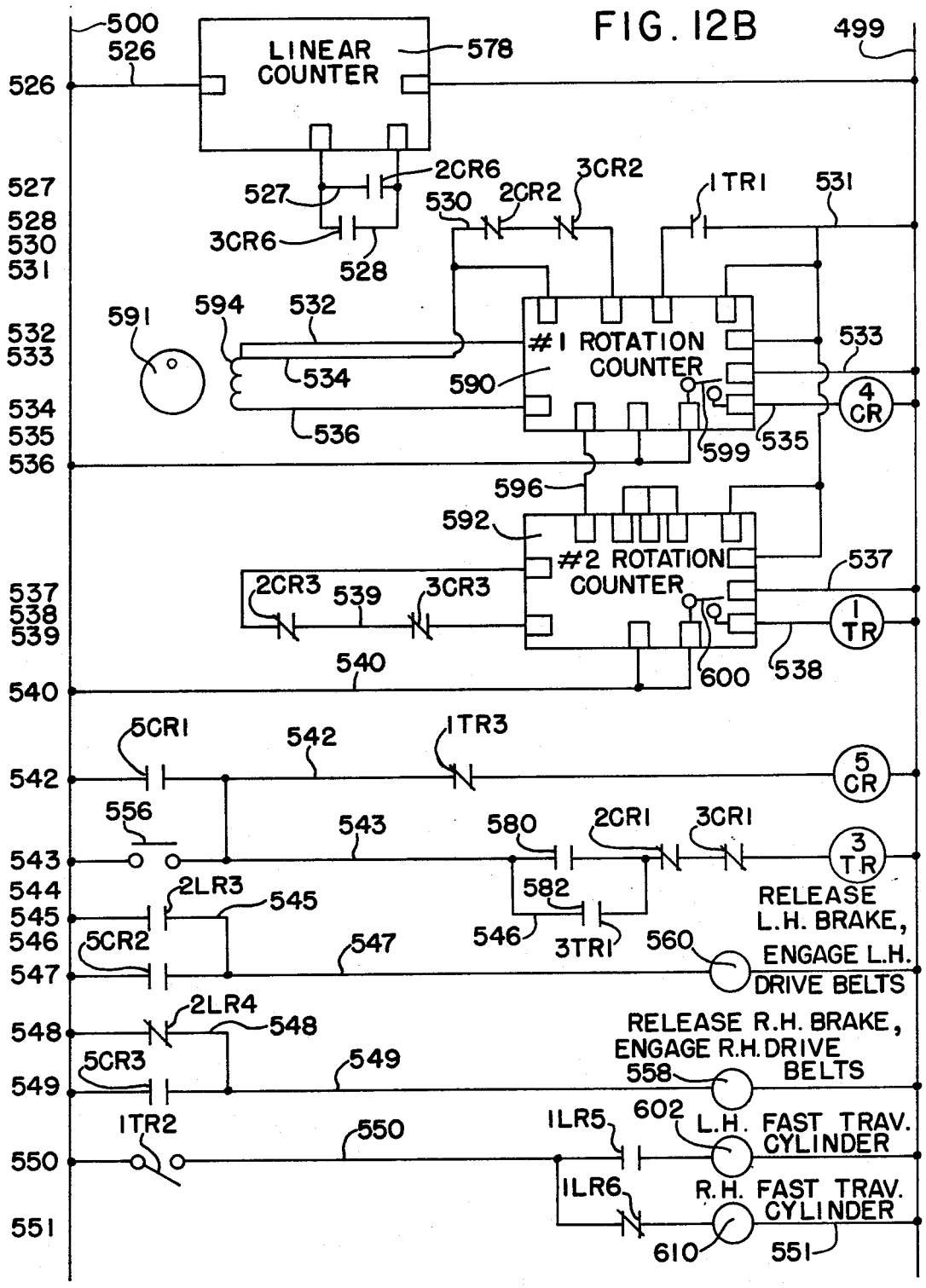

The electrical controls shown in FIGS. 12A and 12B include a pair of power lines 499 and 500 connected to a power source 498. Assuming that the machine has beem momentarily stopped as strand was being wound on the right hand reel 34, operation is resumed by depressing a start button 556 on line 543 which completes a circuit across line 542 and energizes a relay 5CR. Energization of relay 5CR will close its normally open holding contact 5CR1 to maintain current across line 542. Normally open contacts 5CR2 and 5CR3 on lines 547 and 549 respectively are also closed, thereby completing a circuit across those lines to energize solenoid valves 558 and 560 which are effective to actuate the left and right hand reel clutch cylinders, respectively, releasing the brakes and engaging the drive belts.

During winding, the traverse mechanism 32 reciprocates between the flanges of the right hand reel 34 by alternating the direction of rotation of traverse screw 48. The electromagnetic clutches which control the direction of screw rotation are identified by reference numeral 204 for a left hand traverse travel and 206 for a right hand traverse travel. Clutches 204 and 206 are located on lines 566 and 568, respectively, which extend between a pair of DC power lines 505 and 507 which are connected to a rectifier 570. A line 506 connects rectifier 570 to AC power lines 499 and 500. A limit switch 100 is located on line 510 and is spring loaded to normally occupy a neutral position between two contacts 574 and 576. When the traverse mechanism 32 nears the end of its leftward motion across the reel 34, surface 94 of trip cam 90 engages follower 84' on trip dog 82' which actuates switch 100 so that it engages contact 574 to complete a circuit across line 509 thereby energizing relay 1LR. Relay 1LR is a so-called "flip flop" latching relay which has two functional states. Each time that 1LR is energized it stays in one of its states until energized again at which time it is effective to function in its second state. The state which is schematically shown in the wiring diagram is the one which is in effect during the left movement of the traverse mechanism 32 on the screw 48. In this state, contact 1LR1 on line 509 is normally closed and contact 1LR2 on line 512 is normally open. Relay 1LR is always connected to power line 499 and is connected to power line 500 through either line 509 or 512. Two additional contacts, 1LR3 and 1LR4, of 1LR, are located on lines 566 and 568 which are connected across DC power lines 505 and 507. Contact 1LR3 which is located on line 566 is normally closed and contact 1LR4 located on line 568 is normally open. The left hand travel clutch 204 is also located on line 566 and the right hand travel clutch 206 is located on line 568. When switch 100 engages contact 574 to energize 1LR from line 509, it is actuated to its second operating state thereby opening contact 1LR1 and closing contact 1LR2. Contact 1LR3 on line 566 is opened thereby de-energizing left hand travel clutch 204. Contact 1LR4 on line 568 is closed, thereby energizing right hand travel clutch 206. As the traverse mechanism 32 nears the end of its motion to the right, switch 100 is actuated through the action of surface 92 of cam 90 on follower 84 which rocks trip dog 82 and arm 98 of swtich 100. Actuation of switch 100 engages contact 576 which energizes relay 1LR from line 512 which sets relay 1LR in its second functional state. In this state, contact 1LR1 is closed and 1LR2 is open. Also contact 1LR4 on line 568 is opened to de-energize right hand travel clutch 206 and contact 1LR3 on line 566 is closed to energize left hand travel clutch 204. The traverse mechanism 32 continues to reciprocate between the left and right hand flanges of the reel in this manner until strand is completely wound on the reel.

A second "flip flop" latching relay, 2LR is always connected to power line 499 and is selectively connected to power line 500 through either line 515 or 516. Relay 2LR has two functional states. The state which is schematically shown in the wiring diagram is the one which is in effect during the time that strand is being wound on the right hand reel. In this state, contact 2LR4 on line 515 is closed and contact 2LR5 on line 516 is open. Contact 2LR1 on line 519 is open and contact 2LR2 on line 520 is closed. These last two contacts control solenoid valves 584 and 585 which in turn control right and left restraining rolls 214 and 214', respectively, in a manner to be described. Contact 2LR3 on line 545 is open and contact 2LR4 on line 548 is closed in the state shown in the wiring diagram. Line 545 bridges contact 5CR2 and line 548 bridges contact 5CR3 for a purpose to be described in connection with a transfer of winding from the right hand reel to the left. When winding on the left reel, relay 2LR will be in its second state with all of its contacts the opposite from that shown in the electrical diagram. Relay 2LR insures that the mechanisms controlled thereby will be properly oriented for right and left reel winding and transfer from one reel to the other. Solenoid 2LR may be manually set in either state by a three position switch 579. One position (as shown) is neutral, the second position connects lines 515 and 500, and the third position connects line 516 to line 500. If 2LR is in its first state it will be energized to its second state through line 515, upon operation of switch 579. If 2LR is in its second state, it will be energized to its first state through line 516 upon operation of switch 579. This function is useful for properly orienting the machine at start up of a winding operation.

The amount of strand which is wound on the reel is determined by linear counter 578 on line 526. Counter 578 is an SU135 Model 130A which can be purchased from Electronic Counters and Controls Inc. After a certain length of strand has been measured by the counter 578, its normally open contact 580 on line 543 closes to complete a circuit across line 543 and thereby energizes a time delay relay 3TR. Energization of relay 3TR closes its normally open holding contact 582 on line 546. Contact 582 bridges contact 580 and maintains relay 3TR energized. Energization of relay 3TR also closes normally open contacts 3TR2 and 3TR3 on lines 519 and 520 respectively, to initiate a transfer operation. Since at this time, as described above, only 2LR2 is closed, line 520 is energized thereby energizing solenoid valve 584 to actuate the cylinder which deploys the right hand restraining roll 214 to its strand restraining position. After a slight delay, normally open contact 3TR5 on line 521 is closed thereby energizing relay ML. Relay 3TR4 on line 518 is also closed but solenoid MR is not energized since its connection to power line 500 is broken by the open contact 2LR1. Energization of solenoid ML opens its normally closed contact ML1 on line 512 and closes its normally opened contact ML2 on line 508 which bridges contact 574. This insures that after a transfer has been made and normal winding beings on the left hand reel 34', the first motion of the traverse mechanism 32 will be toward the right. If the traverse had been moving toward the left at the time that transfer was initiated, the circuitry associated with latching relay 1LR will be in the first state shown in the electrical diagram that is with contact 1LR1 closed, 1LR2 opened, 1LR3 closed and 1LR4 opened. Closure of contact ML2 will energize 1LR which will reverse the condition of contacts 1LR1, 1LR2, 1LR3, 1LR4 to the opposite as shown in the wiring diagram which causes right hand travel clutch 206 to be energized. If the traverse had been travelling toward the right, closure of ML2 will not energize 1LR since it would be in its second state and 1LR1 at this point would be open. Opening of ML1 would prevent 1LR from becoming energized in spite of the fact that 1LR1 is closed. Since, during the right hand motion of the traverse, 1LR4 is normally closed it will remain closed and right hand travel clutch 206 will remain energized. However, this energization of clutch 206 will be suspended until after the transfer has taken place since a third contact of ML identified as ML3 on line 507 is opened, thereby cutting power to both clutches 204 and 206, preventing either one of them from becoming energized. At the same time, two additional normally open 1LR contacts, ML4 and ML5, on lines 502 and 501, respectively, are closed and normally closed contact ML6 on line 586 connecting lines 501 and 504 is opened to energize a reversible motor 210. This drives the traverse screw 48 at a faster speed than normal and in a direction to cause the traverse mechanism 32 to shift from the right hand reel 34 to a point beyond the left flange of the left hand reel 34' as indicated in FIG. 11. When this point is reached, the traverse strikes a limit switch 1LS to complete a circuit across line 522, thereby energizing a relay 2CR.

Energization of relay 2CR closes its normally open contact 2CR6 on line 527. This line is connected to linear counter 578 in such a manner that closing of contact 2CR6 resets the counter to start another counting sequence.

Energization of relay 2CR opens its normally closed contact 2CR5 on line 512 and closes its contact 2CR4 on line 514 which bridges switch 579. Opening of contact 2CR5 prevents 1LR from becoming energized by the left hand limit switch 100' to be described and insures that 1LR will remain in the state which causes the traverse mechanism 32 to move to the right at the resumption of normal winding. Closing of contact 2CR4 energizes 2LR to set it in its second functional state. This will result in the closing of contact 2LR1 on line 519 and opening contact 2LR2 on line 520 to set the stage for the next transfer from the left reel to 34' to the right reel 34 with respect to the restraining rolls. Since 2LR1 is now closed only solenoid 585 which controls left hand restraining roll 214' will be energized. Contact 2LR3 on line 545 will be opened and contact 2LR4 on line 548 will close. This will have no immediate effect since lines 545 and 548 bridge contacts 5CR2 and 5CR3, respectively which are both closed. However, once the winding on the left hand reel 34' begins, contacts 2LR3 and 2LR4 will be factors in controlling solenoids 558 and 560 which in turn control the left and right reel clutch cylinders. Energization of relay 2CR opens its normally closed contact 2CR1 on line 543 thereby de-energizing time delay relay 3TR. Contacts 3TR1, 3TR2 and 3TR3 open, thereby de-energizing solenoid valve 584 which controls the right hand restraining roll 214 and the right hand restraining roll 214 is retracted by its cylinder to its inactive position. Contact 3TR5 also opens to de-energize relay ML. Contact ML6 closes and contacts ML5 NS ML4 open to deactivate motor 210. Two additional contacts of relay 2CR, 2CR2 and 2CR3 on lines 530 and 539, respectively, are opened. Line 530 is connected to a rotation counter 590 and line 539 is connected to a rotation counter 592. Both of these counters are Durant counters number 1000-210P and can be purchased from the Durant Electronic Corporation. Line 530 is also connected to a Durant number 39400-400 vane pickup sensor which receives impulses from a disc 591 on the end of the main shaft 120. Each revolution of the disc 591 produces one pulse in the Durant pickup sensor 594. A pair of additional lines 532 and 534 also connect the pickup sensor to the rotation counter 590. This pulse is also transmitted to counter 592 through a line 596 from counter 500 so that the two counters count revolution pulses simultaneously. Counter 590 is connected to power line 500 by a line 536 and to power line 499 through a line 533. Counter 592 is connected to power line 500 by a line 540 and to power line 499 by a line 537. Opening of contacts 2CR2 and 2CR3 will set both counters counting. After the empty reel on the left has made at least one revolution, counter 590 operates to close a normally open contact 599 thereby completing a circuit across line 535 and energizing relay 4CR. A relay built into counter 590 maintains contact 599 in the closed position. Energization of relay 4CR causes its normally open contacts 4CR1 and 4CR2 on lines 522 and 524, respectively, to close. Since at this time, limit switch 1LS is closed, a solenoid valve 593 on line 522 is energized and thereby activates the pneumatic cylinder which brings the left hand cutter mechanism into cutting position. Since the strand extends from the extreme left hand position of the travese mechanism 32 across the machine reel 38' on the left to the reel 34 on the right, the strand is snagged on the machine reel 38' during the previously described one revolution of the reel and thereafter cut so that the free end snaps back to the full reel 34 and the end which extends from the traverse mechanism is held by the snagger on the machine reel 38'.

The traverse mechanism 32 remains in the outer extreme position to the left so that additional wraps of strand are wound on the machine reel 38'. The number of additional wraps is determined by customer requirements, such as testing, etc. After a predetermined number of revolutions which is determined by the setting of counter 592, counter 592 operates momentarily to close its normally open contact 600. Closing of contact 600 completes a circuit across line 538 and energizes a time delay relay 1TR. Energization of 1TR closes its normally open contact 1TR1 on line 531. Closing of 1TR1 unlatches the relay within counter 590 which maintains contact 599 closed, thereby opening contact 599 and de-energizing 4CR and consequently de-energizing solenoid valve 593 causing the cylinder which controls the left hand cutter mechanism to deactivate and return the left hand cutter mechanism to its inactive position. Opening of 1TR1 resets the relay within the counter 590 for the next transfer operation. Energization of relay 1TR also closes its normally open contact 1TR2 on line 550 and since contact 1LR5 is closed at this point, a circuit is completed across line 550 to energize a solenoid valve 602 which actuates pneumatic cylinder 72 for moving the traverse mechanism 32 from the extreme position on the left to a winding position within the left flange of reel 34'. Energization of relay 1TR also opens its normally closed contact 1TR3 on line 542 thereby de-energizing relay 5CR. Holding contact 5CR1 on line 542 opens and contacts 5CR2 and 5CR3 on lines 547 and 549, respectively, both open which de-energizes solenoid 558 but allows solenoid 560 to remain energized since contact 2LR3 on line 545 at this point is closed. De-energization of solenoid 558 deactivates the right hand reel clutch cylinder 136 while the left hand reel clutch cylinder remains activated. When the traverse moves from the outer left hand position shown in FIG. 11 to the winding position over reel 34', the outer left hand limit switch 1LS opens and de-energizes relay 2CR.

Upon de-energization of 2CR, contact 2CR1 on line 543 closes and contacts 2CR2 and 2CR3 on lines 530 and 530 respectively, open to reset both counters 500 and 592 in preparation for the next transfer sequence. Contact 2CR6 on line 527 also opens. Contact 2CR5 closes restoring normal traverse control. At this point, the right hand reel 34 is removed and an empty reel is inserted. Also at this point, the left hand reel is rotating and the traverse mechanism 32 begins its motion toward the right flange of the reel 34'. During normal winding, as the traverse mechanism 32 nears the right hand flange of the left reel 34', the cam surface 92 of trip 90 engages a follower 84 on the left side of the machine. This rocks a trip dog 82 to actuate a switch 100' on line 511. Switch 100' is identical to previously described switch 100 and normally occupies a neutral position. However, when actuated by cam 90 of the traverse mechanism 32 as it moves toward the right it engages a contact 604 on line 512 which completes a circuit across line 512 which energizes relay 1LR.

Energization of relay 1LR returns 1LR to its first state as shown in the electrical diagram. In this state, contact 1LR1 is closed, 1LR2 is open, 1LR4 is open to disengage right hand travel clutch 206. 1LR3 is closed to engage the left hand travel clutch 204 causing the traverse mechanism 32 to travel left. As the traverse mechanism 32 nears the left hand flange of the left reel, switch 100' is again actuated by the action of cam 90 on a left hand follower 84' and moved from its neutral position to engage a contact 606 connected to line 509 thereby completing a circuit across line 509 and energizing relay 1LR again. This brings 1LR to its second state and causes it to close contacts 1LR2 and 1LR4 and open contacts 1LR1 and 1LR3. Opening of contact 1LR3 disengages left hand travel clutch 204 and closing of contact 1LR4 energizes right hand travel clutch 206. The traverse mechanism 32 is thereby reciprocated in the above described manner to wind strand on the left hand reel 34'.

After a predetermined length of strand has been wound on the reel 34' as determined by the linear counter 578, contact 580 on line 543 closes to energize relay 3TR thereby closing contacts 3TR1, 3TR2 and 3TR3. Since strand was being wound on the left hand reel 34', relay 2LR is in its second state so that its contact 2LR2 is open and contact 2LR1 is closed, thereby completing a circuit across line 519 and energizing a solenoid valve 585 which actuates a cylinder for deploying the left hand restraining roll 214'. Energization of relay 3TR also closes its contact 3TR4 on line 518 to energize relay MR. Energization of relay MR closes contact MR1 on line 513 and opens contact 509 on line 508. This insures that the traverse drive will be properly oriented at the end of a transfer operation. After the traverse is transferred to the right hand reel, it will occupy the right hand position of the reel and the first motion will be toward the left. If, at the end of winding on the left hand reel, the condition of 1LR was in the first state as shown in the electrical diagram, closing of contacts MR1 and MR2 will have no effect since contact 1LR1 is closed and 1LR2 is open. Relay 1LR will not be energized and contact 1LR3 will remain closed so that after transfer and renewal of a winding operation, the first motion of the traverse will be towards the left as controlled by the left hand travel clutch 204. If, on the other hand, relay 1LR was in its second state at the end of winding prior to transfer, relay 1LR1 would be open and 1LR2 would be closed. Therefore, closing of contact MR1 will complete its circuit across line 512 and energize relay 1LR to thereby open contact 1LR4 and close contact 1LR3 to again set the stage for a left hand movement of the traverse mechanism at the end of transfer. Energization of relay MR also opens its normally closed contact MR3 thereby breaking the circuit across line 507 and deactivating the left hand travel clutch 204 and the right hand travel clutch 206. At the same time, normally closed contact MR4 on line 586 is opened and normally open contacts MR5 and MR6 on lines 504 and 503, respectively, are closed. These lines are connected to reversible motor 210 in such a manner as to energize the motor and drive the traverse screw so that the traverse mechanism is shifted from the left hand reel 34' to the right hand reel 34. This motion continues until the traverse mechanism 32 engages the outer limit switch 2LS located outside of the right hand flange of the right hand reel 34.

Upon engagement by the traverse mechanism 32, switch 2LS is closed thereby energizing relay 3CR on line 525.

Energization of relay 3CR closes its normally open contact 3CR6 online 528. This line is connected to linear counter 578 in such a manner that closing of contact 3CR6 resets the counter to start another counting sequence.

Energization of relay 3CR also opens its normally closed contact 3CR5 on line 509 and closes its contact 3CR4 on line 517 which bridges switch 579. Opening of contact 3CR5 prevents 1LR from becoming energized by the right hand limit switch 100 and insures that 1LR will remain in the state which causes the traverse mechanism 32 to move to the left at the resumption of normal winding. Closing of contact 3CR4 energizes 2LR to set it in its first functional state. This will result in the closing of contact 2LR2 on line 520 and opening of contact 2LR1 on line 519 to set the stage for the next transfer from the right reel 34 to the left reel 34' with respect to the restraining rolls. Since 2LR2 is now closed, only solenoid 584 whic controls right hand restraining roll 214 will be energized. Contact 2LR3 on line 545 will be closed and contact 2LR4 on line 548 will be opened. This will have no immediate effect since line 545 and 548 bridge contacts 5CR2 and 5CR3, respectively, which are both closed. However, once the winding on the right hand reel 34 begins, contacts 2CR3 and 2CR4 will be factors in controlling solenoids 558 and 560 which in turn control the left and right reel clutch cylinders, respectively. Energization of relay 3CR opens its normally closed contact 3CR1 on line 543 thereby de-energizing time delay relay 3TR.

De-energization of relay 3TR opens its holding contact 3TR1 online 546 and opens its contacts 3TR2 and 3TR3 on lines 519 and 520, respectively. Opening of contact 3TR2 has the effect of de-energizing solenoid 585 which controls the left hand restraining roll 214' and the left hand restraining roll 214' is retracted by its cylinder to its inactive position. Contact 3TR4 also opens to de-energize relay MR. When this happens, contact MR4 closes and contacts MR5 and MR6 open to deactivate reversible motor 210. Energization of relay 3CR also opens its normally closed contacts 3CR2 and 3CR3 on lins 530 and 539, respectively, which initiates a counting sequence for counters 590 and 592 in a manner described in connection with the previous transfer.

After the empty reel 34 on the right has made one revolution, counter 590 operates to close contact 599 thereby energizing relay 4CR. Energization of relay 4CR causes its normally open contacts 4CR1 and 4CR2 on lines 522 and 524, respectively to close. Since at this time, limit switch 2LS is closed a solenoid valve 608 on line 524 is energized and thereby activates pneumatic cylinder 250 which brings the right hand cutter mechanism 240 into cutting position. Since the strand extends from the extreme right hand position of the traverse mechanism 32 across the machine reel 38 on the right, the strand is snagged on the machine reel 38 during the above described one revolution of the reel and thereafter cut so that the free end snaps back to the full reel 38' and the end which extends from the traverse mechanism 32 is held by the snagger on the machine reel 38.

The traverse mechanism 32 remains in the outer extreme position to the right so that additional wraps of strand are wound on the machine reel 38. After a predetermined number of revolutions, counter 592 operates to momentarily close its normally open contact 600. Closing of contact 600 completes a circuit across line 538 and energizes time delay relay 1TR. Energization of relay 1TR closes its normally open contact 1TR1 on line 531. Closing of 1TR1 unlatches the relay within counter 590 which maintains contact 599 closed, thereby opening contact 599 and de-energizing 4CR and consequently de-energizing solenoid valve 608 causing the cylinder 250 to deactivate and return the right hand cutter mechanism 240 to its inactive position. Opening of 1TR1 resets the relay within the counter 590 for the next transfer operation. Energization of relay 1TR also opens its normally closed contact 1TR2 on line 550. Since contact 1LR6 is closed at this point, a circuit is completed across line 551 to energize a solenoid valve 610 which actuates a pneumatic cylinder which is identical to cylinder 72 for moving the traverse mechanism 32 from the extreme position on the right to a winding position within the right flange of reel 34.

Energization of relay 1TR also opens its normally closed contact 1TR3 on line 542 thereby de-energizing relay 5CR. Holding contact 5CR1 on line 542 opens and contacts 5CR2 and 5CR3 on lines 547 and 549, respectively, both open which de-energizes solenoid 560 but allows solenoid 558 to remain energized since contact 2LR4 on line 548 at this point is closed. De-energization of solenoid 560 deactivates the left hand reel clutch cylinder while the left hand reel clutch cylinder remains activated. When the traverse moves from the outer right position to the winding position over the right hand portion of reel 34, the outer left hand limit switch 1LS opens and de-energizes relay 3CR.

Upon de-energization of relay 3CR, contact 3CR1 on line 544 closes and contacts 3CR2 and 3CR3 on lines 530 and 539, respectively, close to reset both counters 590 and 592 in preparation for the next transfer sequence. Normally open contacts 3CR6 on line 528 opens. Contact 3CR5 closes restoring normal traverse control. At this point, the left hand reel 34' is removed and an empty reel is inserted. Also at this point, the right hand reel is rotating and the traverse mechanism begins its motion toward the left flange of the reel 34. After an empty reel is inserted on the left, switch 556 on line 544 is manually closed to again energize relay 5CR on line 542.

We claim:

1. Winding apparatus for the continuous winding of an advancing strand comprising:

(a) a pair of co-axially mounted, spaced, independently driven, and removable reels;

(b) a pair of machine reels mounted for rotation with said reels about a common axis, one of said machine reels is mounted adjacent the remote end of one of said reels and the other is mounted adjacent the remote end of the other of said reels;

(c) snagger means disposed between the remote end of each of said reels and its associated machine reel and mounted for rotation with said machine reel;

(d) means for traversing strand onto one of said reels until a predetermined length of strand has been wound thereon;

(e) restraining means for temporarily restraining the strand and maintaining it in a winding relationship with the filled reel;

(f) means for rapidly moving the traverse means across the other reel into a position to direct said strand onto the machine reel associated with said other reel;

(g) means for withdrawing the restraining means thereby permitting the restrained strand to change its path to a path which intersects the path of the snagger means;

(h) means for severing the strand between the snagger and the filled reel after at least one revolution of strand has been wound onto the machine reel; and (i) means for moving the traverse means into normal traversing relation with the other reel after a predetermined number of revolutions of strand has been wound onto said machine reel.

2. The winding apparatus as set forth in claim 1 wherein the means for severing the strand comprises an electronic counter for counting a predetermined number of revolutions of strand wound onto the machine reel before activating the severing means.

3. The winding apparatus as set forth in claim 1 wherein the means for moving the traverse mechanism into normal traverse relation with the other reel comprises a counter means for counting a predetermined number of revolutions of strand wound onto the machine reel before activating the mechanism to shift the traverse mechanism into normal traversing relation with the other reel.

4. The winding apparatus as set forth in claim 1 wherein the means for rapidly moving the traverse mans across the other reel comprises means for measuring a predetermined length of strand and control circuit means activated by said measuring means for disabling the normal traverse driving means and for engaging a rapid traverse driving means.

5. The winding apparatus as set forth in claim 1 wherein said pair of removable reels are mounted on independent, spaced co-axial drive shafts.

6. The winding apparatus as set forth in claim 1 wherein the means for traversing strand onto said reels comprises means for adjusting the length of the normal traverse motion at a point remote from said reels and outside of the area wherein said reels are located.

7. The winding apparatus of claim 1 wherein the independent drive for each of said reels comprises a brake mechanism for stopping said reel whenever said drive is disengaged.

8. The winding apparatus as set forth in claim 7 wherein means are provided for disengaging the drive for each of said reels and for applying the brakes thereto should the electrical power supplied to said winding apparatus fail.

9. The winding apparatus as set forth in claim 1 wherein the traverse means comprises a traverse block, a traverse screw, a traverse nut disposed in driving relationship with said screw, and latch means for latching said traverse nut to said traverse block in either a machine reel winding position or a reel winding position, selectively.

10. Winding apparatus for the continuous winding of an advancing strand comprising:

(a) a pair of co-axially mounted, spaced, independently driven, and removable reels;

(b) strand traverse means for alternately distributing strand to each of said reels;

(c) a pair of machine reels mounted for rotation with said reels about a common axis, one of which is mounted adjacent the remote end of one of said reels so that said reels are disposed for rotation about said common axis between said machine reels;

(d) snagger means disposed between the remote end of each of said reels and its machine reel;

(e) traverse means for distributing said strand onto one of said reels until a predetermined amount of strand is wound thereon;

(f) means for restraining said strand disposed adjacent the adjacent ends of said reels and adapted to move into a position to intercept said strand when said strand moves past the adjacent end of the reel being filled and to continue to guide said strand onto said filled reel;

(g) means for rapidly moving said traverse means across the empty reel into a position to deliver strand to the machine reel associated therewith;

(h) cutter means adjacent the remote end of each of said reels and adapted to sever said strand near the snagger associated with said reel; and (i) control means comprising:

(1) means for moving said restraining means into strand interception position when a predetermined length of strand has been wound on a reel;

(2) means for activating the means for moving the traverse means to the machine reel associated with the other reel;

(3) means for withdrawing the restraining means;

(4) means for activating the cutter means after a first predetermined number of revolutions of strand has been wound onto the machine reel; and (5) means for moving the traverse means into normal winding position after a second predetermined number of revolutions of strand, in excess of said first predetermined number, has been wound onto said machine reel.

* * * * *